US010814213B2

(12) United States Patent
Velasco et al.

(10) Patent No.: US 10,814,213 B2
(45) Date of Patent: Oct. 27, 2020

(54) GAME AND METHOD OF PLAYING THE SAME

(71) Applicants: Sean Velasco, Santa Monica, CA (US); Alec Faulkner, Los Angeles, CA (US); David Anthony D'Angelo, Los Angeles, CA (US); Shane Calimlim, Valencia, CA (US); Carl-Henrik Skårstedt, Playa Vista, CA (US); Ian Michael Flood, Playa Vista, CA (US); Adam David Pascual, Los Angeles, CA (US); Michael Joseph Herbster, Pacomia, CA (US); Shannon Noriko Hatakeda, Playa Vista, CA (US); Nickolas A. Wozniak, Los Angeles, CA (US); Morgan Guyer, Glendale, CA (US)

(72) Inventors: Sean Velasco, Santa Monica, CA (US); Alec Faulkner, Los Angeles, CA (US); David Anthony D'Angelo, Los Angeles, CA (US); Shane Calimlim, Valencia, CA (US); Carl-Henrik Skårstedt, Playa Vista, CA (US); Ian Michael Flood, Playa Vista, CA (US); Adam David Pascual, Los Angeles, CA (US); Michael Joseph Herbster, Pacomia, CA (US); Shannon Noriko Hatakeda, Playa Vista, CA (US); Nickolas A. Wozniak, Los Angeles, CA (US); Morgan Guyer, Glendale, CA (US)

( * ) Notice: Subject to any disclaimer, the term of this patent is extended or adjusted under 35 U.S.C. 154(b) by 12 days.

(21) Appl. No.: 15/639,184

(22) Filed: Jun. 30, 2017

(65) Prior Publication Data

US 2019/0001217 A1 Jan. 3, 2019

(51) Int. Cl.
*A63F 3/00* (2006.01)
*A63F 3/02* (2006.01)
(Continued)

(52) U.S. Cl.
CPC ..... *A63F 3/00003* (2013.01); *A63F 3/02* (2013.01); *A63F 2001/0483* (2013.01); *A63F 2009/0695* (2013.01)

(58) Field of Classification Search
CPC ..... A63F 1/00
(Continued)

(56) References Cited

U.S. PATENT DOCUMENTS 3,804,415 A * 4/1974 Ryan ..... A63F 3/00574 273/241
4,185,834 A * 1/1980 Mozzi ..... A63F 3/0423 273/241
(Continued)

*Primary Examiner* — John E Simms, Jr.
*Assistant Examiner* — Dolores R Collins
(74) *Attorney, Agent, or Firm* — Omni Legal Group PL; Omid E. Khalifeh; Ariana Santoro

(57) ABSTRACT

A game and method of playing the same is characterized by offensive strategy having an object of occupying a majority of designated goal space(s). The game comprises a board defined by spaces arranged, in part, as a grid. One or more of the spaces is visually distinguishable from the others as a goal space. Players may take turns in sequence placing a tile from their respective decks of such tiles on a space on the board. Tiles may comprise one or more movement indicators which enable a player to move tiles already occupying a space on the board into an adjacent unoccupied space, and further prevent a player from moving certain tiles already occupying a space on the board. When a game ending event occurs, the player whose tiles occupy the most goal spaces may be deemed the winner.

11 Claims, 9 Drawing Sheets

(51) Int. Cl.
*A63F 1/04* (2006.01)
*A63F 9/06* (2006.01)

(58) Field of Classification Search
USPC ..... 273/292
See application file for complete search history.

(56) References Cited

U.S. PATENT DOCUMENTS 4,244,580 A * 1/1981 Hoyles ..... A63F 3/00 273/248
4,331,333 A * 5/1982 Willcocks ..... A63F 3/00176 273/238
5,054,788 A * 10/1991 Kirby ..... A63F 3/0423 273/272
5,507,494 A * 4/1996 De Bono ..... A63F 3/00094 273/236
5,553,844 A * 9/1996 Aaron ..... B65H 39/115 271/288
5,607,159 A * 3/1997 Bryson ..... A63F 9/0415 273/146
5,690,332 A * 11/1997 Rechs ..... A63F 3/02 273/260
6,254,101 B1 * 7/2001 Young ..... A63B 71/04 273/242
6,581,937 B1 * 6/2003 Crisswell ..... A63F 3/0415 273/272
6,893,020 B1 * 5/2005 Snyder ..... A63F 9/20 273/287
7,644,929 B2 * 1/2010 Frauhammer ..... B23Q 3/12 279/19.4
7,938,401 B2 * 5/2011 Roemer ..... G07F 17/32 273/273
7,967,670 B2 * 6/2011 Burbidge ..... A63F 13/10 273/242
9,295,768 B2 * 3/2016 Kassab ..... A61M 25/00
9,597,581 B2 * 3/2017 Kingsley ..... A63F 3/00643
9,597,582 B2 * 3/2017 Kingsley ..... A63F 3/00643
2005/0017447 A1 * 1/2005 Geshwind ..... A63F 3/00176 273/236
2005/0017449 A1 * 1/2005 Belcher ..... A63F 3/00075 273/284
2007/0123328 A1 * 5/2007 Burbidge ..... A63F 13/10 463/9
2007/0228655 A1 * 10/2007 Teeple ..... A63F 1/00 273/292
2007/0284819 A1 * 12/2007 Ledger ..... A63F 1/00 273/292
2011/0172014 A1 * 7/2011 Roemer ..... G07F 17/32 463/37
2012/0018950 A1 * 1/2012 Kingsley ..... A63F 3/00643 273/272
2012/0187626 A1 * 7/2012 Kaspick ..... A63F 3/0415 273/236
2013/0072272 A1 * 3/2013 Kingsley ..... A63F 3/00643 463/9
2015/0028543 A1 * 1/2015 Reid ..... A63F 3/02 273/260
2015/0076767 A1 * 3/2015 Benedict, III ..... A63F 3/00574 273/266
2016/0296835 A1 * 10/2016 Cunningham ..... A63F 9/20
2018/0085659 A1 * 3/2018 Wilk ..... A63F 3/0423

* cited by examiner

GAME AND METHOD OF PLAYING THE SAME

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to games and, more particularly, to a board game having selectable pieces that may be used to alter the position of an opponent's pieces in the pursuit of dominating certain spaces that characterize an inbounds region of the board.

BACKGROUND

A variety of recreational games exist on the market including those having boards on which gaming pieces may be placed and moved. Some games currently in existence employ, in part, a grid-like board and may to some extent involve overtaking an opponent by way of strategic movement of a player's own pieces. For instance, in checkers, well known in the art, pieces are moved diagonally across a checkered board until one player has captured all of his or her opponent's pieces. In chess, pieces are moved according to various restrictions until a player's "king" piece is prevented from avoiding capture during a move.

Some other proposals for game play on a board have been made. Examples include, for instance, U.S. Pat. No. 3,804,415 to Ryan describing a game board configured to receive pegs whose placement is restricted to certain regions of the board; U.S. Pat. No. 5,553,854 to Rum teaching a gridded board configured to receive somewhat rectangular geometric pieces where the objective of such game is to prevent other players from placing gaming pieces; and U.S. Pat. No. 5,507,494 to De Bono describing a game having a grid-like game board wherein an object is to occupy a goal spot with a portion of a gaming piece.

Still, none of these in existence comprise beneficial characteristics descried in the following disclosure. Thus, there remains a need for a game that employs different offensive and defensive strategies than those described to win the game.

SUMMARY

The present disclosure is directed to offensive and defensive strategy games played across spaces defining a modified grid until movement of gaming pieces on the board is, one way or another, prevented.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

The game comprises a board defined by spaces arranged, in part, as a grid wherein one or more of the spaces is visually distinguishable from the others as a goal space. Players may take turns in sequence placing a tile from their respective decks of such tiles on a space on the board.

Tiles may comprise one or more movement indicators defining instructions for moving tiles over the course of game play. For example, some movement indicators may permit a player to move tiles already occupying a space on the board into an adjacent unoccupied space, and further prevent a player from moving certain tiles already occupying a space on the board. Thus, it is contemplated that movement indicators may operate either or both of offensively and defensively. As one non-limiting example, movement indicators may comprise upward, downward, leftward, and rightward arrowheads variously displayed on tiles employed over the course of game play. Each arrowhead may visually communicate to a player whether he may push a tile already placed on the game board into an adjacent spot unoccupied by any other tiles. Movement indicators displayed on tiles already placed on the game board may in similar fashion communicate to a player whether he may be prevented from pushing a placed tile with an incoming tile. As a clarifying example, a player may deploy a tile displaying an upward tile to offensively, and perhaps advantageously, push a tile on the game board upward into an overhead, adjacent and unoccupied space in either the inbounds region or even an out of bounds region. However, a player attempting to deploy a tile may also be defensively prevented from pushing any tiles on the game board which display movement indicators in opposition to his or her own. Thus, the tile having an upward movement indicator may be prevented from upwardly pushing a tile displaying its own downward movement indicator.

It is contemplated that the movement indicators may define instructions for moving tiles in general and may even comprise instructions that are more complex than simple cardinal directions. For example, some tiles may comprise movement indicators that visually indicate that a particular tile is lockable or otherwise cannot be moved from its location once placed on a space in the inbounds region of the board. Some may permit pushing or other movement of other limited tiles. Some may permit tiles to be stacked vertically on top of one another. Some may even operate to remove or reclaim tiles on the board. Thus, the variety of movement indicators which may define instructions for moving tiles over the course of game play is innumerable and should not be limited by any of those clarifying examples described.

In some embodiments, one or more of certain spaces defining the inbounds region of the game board may be visually distinguishable from others to indicate that such spaces define a goal. It may be desirable that when placing and pushing tiles on and across spaces defining the game board to aim to occupy each goal space with the object of occupying a majority of such goal spaces at the end of the game. Indeed, the game may end when each inbounds space on the board, for example, is occupied by a tile, and the player whose tiles occupy the most goal spaces may be deemed the winner.

The game and method of playing the same may include additional steps. For instance, in some embodiments, the players may be prompted to optionally edit their deck to comprise certain tiles, as may be desired, prior to game play.

In one embodiment, a winning player may be prompted to select a reward or prize. For instance, in some embodiments, a player may be presented with an option to select in-game coins, additional tiles, or other prizes as may be desirable.

Additional functionality may be included if any of the foregoing and other exemplary methods are implemented by an electronic device. For instance, in one embodiment, it is contemplated that predictive animations may be implemented to demonstrate the effect of that a particular move may have on a tile placed on the game board before a player chooses to make such move official.

Thus, it is an object of the invention to provide a board game that enables offensive movements on a gaming board.

It is another object of the invention to utilize a modified grid as a game board.

It is another object of the invention to incorporate defensive mechanisms in the gaming pieces themselves.

It is another object of the invention to combine elements of chance and strategy in a single game.

It is yet another object of the game to provide an opportunity to personally build a collection of gaming pieces, or tiles, having strategically desirable movement indicators.

It is still another object of the invention to provide selectable pieces that may be used to alter the position of an opponent's pieces in the pursuit of dominating certain goal spaces.

One or more of the above-disclosed embodiments, in addition to certain alternatives, are provided in further detail below with reference to the attached figures. The disclosed subject matter is not, however, limited to any particular embodiment disclosed.

Figure 1:
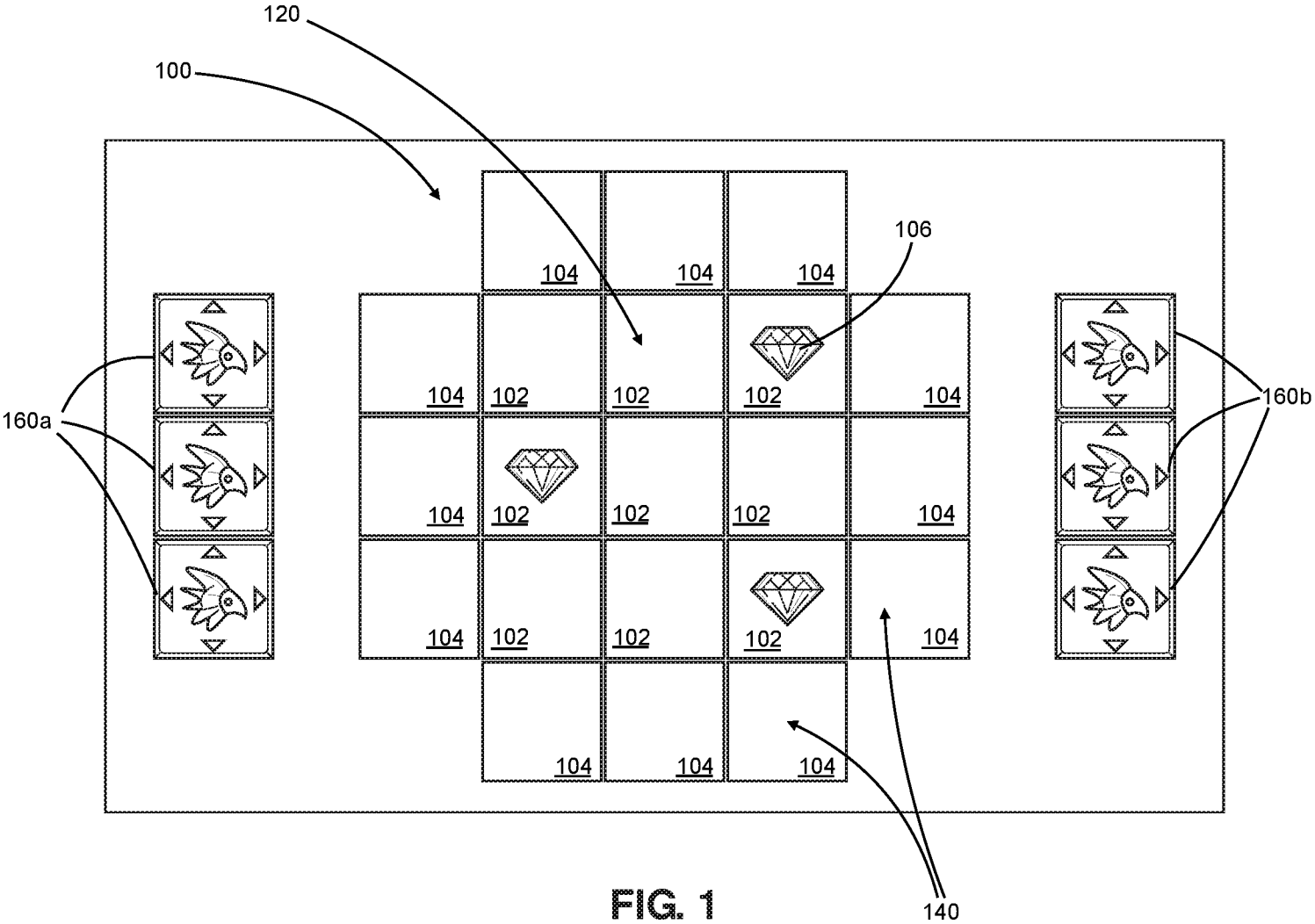
FIG. 1 shows a playing board and tiles in accordance with one embodiment of the invention.

One embodiment of the invention is implemented as a program product for use with a computer system. The program(s) of the program product defines functions of the embodiments (including the methods described herein) and can be contained on a variety of computer-readable storage media. Illustrative computer-readable storage media include, but are not limited to: (i) non-writable storage media (e.g., read-only memory devices within a computer such as CD-ROM disks readable by a CD-ROM drive) on which information is permanently stored; (ii) writable storage media (e.g., floppy disks within a diskette drive or hard-disk drive) on which alterable information is stored. Such computer-readable storage media, when carrying computer-readable instructions that direct the functions of the present invention, are embodiments of the present invention. Other media include communications media through which information is conveyed to a computer, such as through a computer or telephone network, including wireless communications networks. The latter embodiment specifically includes transmitting information to/from the Internet and other networks. Such communications media, when carrying computer-readable instructions that direct the functions of the present invention, are embodiments of the present invention. Broadly, computer-readable storage media and communications media may be referred to herein as computer-readable media.

In general, the routines executed to implement the embodiments of the invention, may be part of an operating system or a specific application, component, program, module, object, or sequence of instructions. The computer program of the present invention typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, an embodiment of the game may comprise a game board 100, having an inbounds region 120 defined by laterally and longitudinally contiguous spaces 102 arranged in as a grid such as the three-square by three-square potion of the board 100 depicted in FIG. 1. The spaces 102 may define an equilateral grid as depicted in the figures, however, it is contemplated that a grid defined by an unequal number of rows and columns may be deployed without departing from the invention.

Additionally, an out of bounds region 140 may comprise additional spaces 104 contiguously flanking each side of the inbounds region 120. At least one space 102 defining the inbounds region 120 of the board may be optionally, visually distinguishable from any other space(s) 102, 104 to define a goal. For instance, three spaces 102 defining the inbounds region 120 of the game board 100 have a diamond figure 106 incorporated thereon to visually distinguish goal spaces from other inbounds spaces. Of course, one skilled in the art will recognize that other figures, designs, numbers, and even colors may be incorporated onto such goal spaces to distinguish them from other spaces 102, 104 comprising the game board 100. It is also contemplated that each and every space 102 defining the inbounds region 120 of the board may itself define a goal. Thus, diamonds 106 are drawn by way of example only and not limitation. Similarly, though additional spaces 104 are drawn as contiguously flanking each side of the inbounds region 120 to comprise the out-of-bound region 140, it is also contemplated that one or more visual markers, rather than or in addition to relative position, may be provided to indicate that such spaces 104 comprise the out of bounds 140 region. That is, the additional spaces 104 need not necessarily flank each side of the inbounds region 120. The foregoing is offered by way of example only and not of limitation.

Figure 2A:
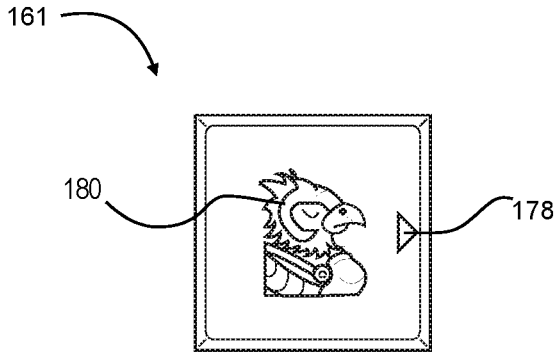
FIGS. 2A-C show various embodiments of tiles with movement indicators in accordance with one embodiment of the invention.
Figure 2B:
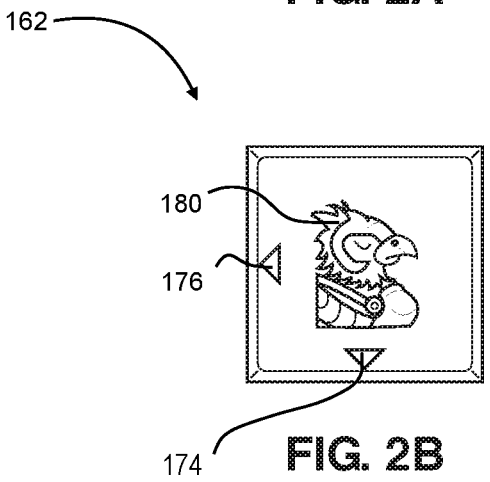
Figure 2C:
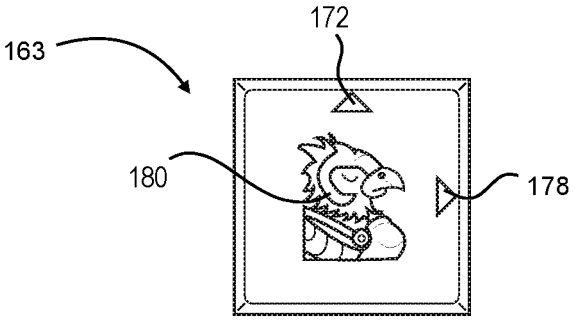

An embodiment of the game may additionally comprise at least a first and second set of a plurality of tiles 160*a*, 160*b* which may be disposed by at least a first and a second player, respectively, onto spaces comprising the inbounds region 120 of the game board 100 according to steps in a method of playing the game discussed in detail with reference to FIGS. 3-10 below. With reference to FIGS. 2A-2C, alternative, non-limiting, embodiments of tiles 161, 162, 163 comprising the game may comprise one or more movement indicators which define instructions related to possible movement of tiles on the game board. For instance, the figures show a variety of movement indicators as an upward arrowhead 172, downward arrowhead 174, leftward arrowhead 176, and rightward arrowhead 178, or other directional symbol, including combinations of the same, alternatively drawn on embodiments of the tiles 161, 162, 163. Additionally, each tile may comprise an aesthetic design 180 which may distinguish one player's tiles from another's. A stylized bird is drawn in the figures, however, an endless variety of designs are contemplated and should not be seen to limit the invention.

Each element comprising the game may be digitally rendered for viewing and manipulation on a computer screen as a video game, though it is also contemplated that the elements may comprise physical pieces configured for competitive play among two human players. Thus, it should be understood that the particular form taken by the game should not limit the invention.

Figure 3:
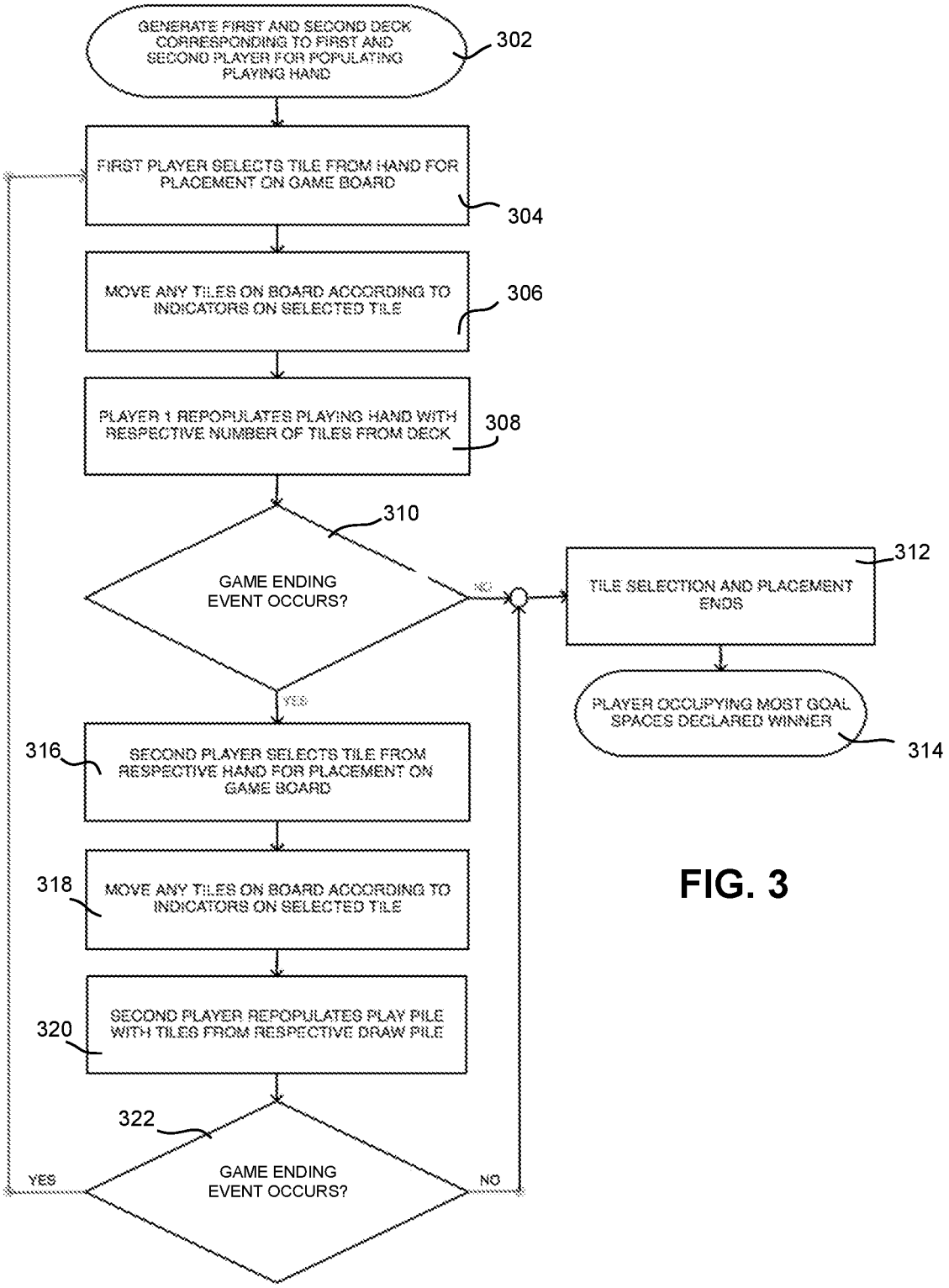
FIG. 3 is a flowchart illustrating an exemplary method of playing a game in accordance with one embodiment of the invention.

FIG. 3 is a flowchart depicting an exemplary embodiment of a method for playing the disclosed game. It is contemplated that the method may be performed by players in sequence, though the sequence may be altered by mandatorily or optionally per movement indicators displayed on tiles in play. Additionally, it should be noted that at least one of the players may be a computer programmed to execute one or more turns in sequence with a human player. In such instances, a human player may avoid a need of recruiting another human to play the game with him or her, expediting his ability to play the game on his own.

In accordance with one embodiment, the game may begin when a first and a second deck of tiles, corresponding respectively to a first and a second player, are generated (block 302). This may be done digitally, or physically. For instance, the first and second players may select a plurality of tiles from a larger pool to create their own deck comprising some predetermined number of tiles specified prior to game play. As another example, the decks may be preassembled. As still another example, the deck may be randomly generated by a computing device.

Next, the players may take turns in sequence of placing tiles selected from their respective decks and placing them on inbounds spaces comprising the game board. More particularly, though, the step of placing a tile may be affected by any of the movement indicators comprising the tile itself and any tiles already occupying spaces on the game board. In other words, a first player may select a tile from his hand to place on the game board (block 304), then, one or more tiles on the board may be moved according to the indicators on the selected tile (block 306). It is contemplated that a selected tile may also be prevented from occupying a particular space, or even causing tiles on the board to be moved, however, this relationship and the offensive movement of tiles in general will be made clearer with reference to additional figures below.

With continued reference to FIG. 3, the first player may then end his turn by repopulating his hand with additional tiles from his deck (block 308). If a game-ending event occurs, for example, if the player finds himself (or herself, as the case may be) unable to make a move that would affect the occupation of any goal space (block 310) in his favor, then tile selection and placement of such tiles ends for both players (block 312), and the player whose tiles occupy the most goal spaces may be declared the winner (block 314). In other words, if a player has no tiles available for selection which would effectively alter the occupation of a goal space in his favor, then game play ends. If altering occupation of one or more goal spaces in favor of the selecting player is still possible, or if any goal space remains unoccupied, then the other player may take his turn to perform the same steps. That is, the second player may select a tile from his respective hand for placement on the game board (block 316), move any tiles on the board according to any movement indicators on his selected tile (block 318), and then repopulate his play pile with tiles from his respective deck (block 320).

As above, if the second player finds himself unable to make a move that would affect the occupation of any goal space (block 322) in his favor, or another game-ending event occurs, then tile selection and placement of such tiles ends for both players (block 312), and the player whose tiles occupy the most goal spaces may be declared the winner (block 314). Other possible game-ending steps or events will of course be apparent to those skilled in the art. For instance, in some embodiments, the game may end when all of the spaces comprising the game board are occupied whether or not any player is able to select a tile that would allow him to affect occupation of any goal spaces in his favor. As another example, the game may end when a player runs out of tiles to play from his hand and deck. In some embodiments, game ending events may comprise achieving certain stated objectives or challenges in addition, or even alternatively, to mere occupation of goal spaces. For instance, players may be challenged to achieve a game-ending event in a limited number of turns in sequence. As another example, one or more of the players may be challenged to achieve a game-ending event having the board preset with one or more tiles as obstacles to their own tile placement. Thus, the foregoing is offered as a limited clarifying example of many possibilities. In any event, it is contemplated that the player whose tiles occupy the most goal spaces may be declared the winner.

An illustrated embodiment of the method in progress is provided in FIGS. 4-10. It will be understood by one skilled in the art that the particular arrangement and appearance of the game board and any tiles in such figures are offered by way of example only, and not of limitation. Indeed, the placement of any tiles on the board may depend on personal choice and any strategy as may be developed by the players themselves. Additionally, the breadth of possible movement indicators displayable on the tiles may alter progression, or even make certain pictured combinations impossible. As such, it should be understood that the illustrations will not limit the invention.

Figure 4:
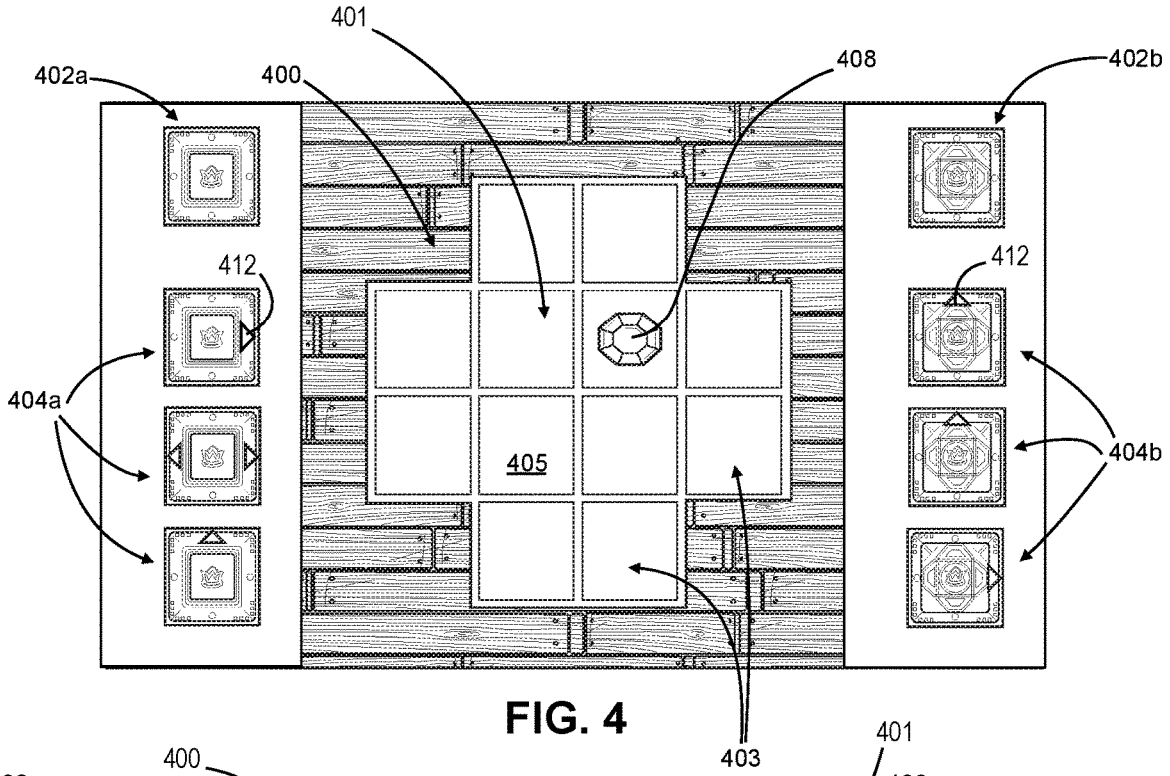
FIGS. 4-10 illustrate progressive game play in accordance with one embodiment of the invention.
Figure 5:
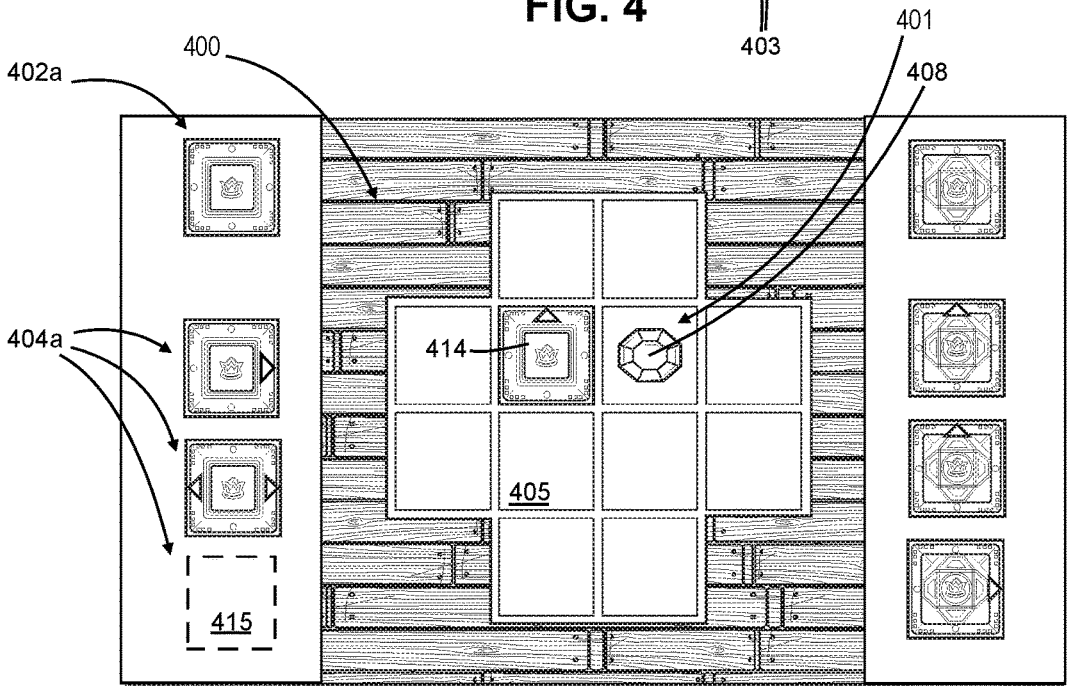

Turning attention to FIG. 4, at the start of game play, each player may have his own deck 402*a*, 402*b* from which to draw tiles comprising his hand 404*a*, 404*b*. Such decks 402*a*, 402*b* are placed on opposing sides of an embodiment of the game board 400 for ease of understanding, however, it is contemplated that the decks 402*a*, 402*b* may be placed in any convenient or otherwise desirable location. Additionally, it should be noted that the game board 400 depicted in FIG. 4 comprises an inbounds region 401 defined by an equilateral two-space by two-space, rather than three-space by three-space, grid flanked on each side by two contiguous spaces defining the out-of-bounds region 403. Similarly, the number of any visually distinguishable goal spaces, here marked by a gemstone 408, may vary. The placement of any visually distinguishable goal spaces may vary as well. For instance, such placement may be preset, randomly selected, or even chosen by one or more of the players and should not, therefore, be seen to limit the invention. It is even contemplated that in some embodiments, effectively forbidden or invalid spaces which may not be occupied by any player may also be included in the inbounds region 401 of the game board 400, as may be desired. Thus, it may be seen that neither the game, nor method of playing such game, will depend on the number and/or quality of spaces 405 defining the game board 400.

It should also be noted that although the gemstone 408 visually marking the goal space remains in the same relative spot throughout game play illustrated in FIGS. 4-10, it is contemplated that in some embodiments the position of the visually distinguishable goal space(s) may vary. That is, rather than providing static visually distinguishable goal space(s), such goal space(s) may instead be dynamic. This may enhance or otherwise affect game progression and strategic play.

In some embodiments, the decks 402*a*, 402*b* may be visually distinguishable from one another. For example, the decks 402*a*, 402*b* may comprise distinguishable, graphic designs, as shown in the figures. As another non-limiting example, the decks may be different colors. In the figures, each player's deck 402*a*, 402*b* is arranged so that any movement indicators are hidden from view. This may introduce chance or randomness to progression of an otherwise strategic game, though it is possible to implement the method of playing the game so that movement indicators on the tiles comprising the deck are visible as well.

Each player's hand 404*a*, 404*b* may then comprise a limited number of tiles taken from his own deck 400*a*, 400*b*. For example, each player's hand 404*a*, 404*b* may comprise three tiles each as shown, however it is also contemplated that each player's hand 404*a*, 404*b* may comprise more or less tiles as may be desired and agreed upon by the players.

In some embodiments, the tiles may be formed as rugged, coated or uncoated cardstock, thin plastic, or any other material known by those skilled in the art to be suitable for gaming purposes. In other embodiments, the tiles may be digitally represented as two-dimensional graphics, also known to those skilled in the art.

In some embodiments, each player's hand 404*a*, 404*b* may be populated by overturning a corresponding number of tiles from the top of his physically or digitally stacked deck 400*a*, 400*b*, however, it may be possible in some embodiments to permit each player to choose tiles randomly from throughout the deck to populate his hand instead. In some embodiments, it may even be possible to permit selection of tiles comprising a player's hand from a deck having any movement indicators revealed.

As shown in the figures, tiles comprising each of the players' hands 404*a*, 404*b* may be overturned so that any movement indicators, drawn as exemplary and variously placed arrow heads 412, on the tiles may be visible to all of the players in the game. It is contemplated that awareness of an opponent's possible moves may educate another player's own deployment of tiles on the game board 400, which may have an effect on overall strategy employed during game play. In other embodiments, however, the movement indicators 412 may only be visible to the player himself.

Execution of a number of turns in sequence, and some of the effects that various movement indicators may have on placed tiles is illustrated in the following drawings. For instance, with reference to FIG. 5, a first player, corresponding to the deck 402*a* and hand 404*a* laid out along the left side of the game board 400, may select a tile 414 from his hand 404*a* (taken from the area defined by corresponding dashed box 415) for placement on a space 405 comprising the inbounds region 401 of the game board 400. It is contemplated that in some embodiments, a player may be prohibited from placing a tile directly on a goal space, such as that visually distinguished from spaces 405 comprising the game board 400 with a depiction of a gem 408. Instead, a player may come to desirably occupy such space with his tile by offensively utilizing movement indicators provided on his tiles (discussed below). It should also be noted that in the event that game play involves an additional stated objective or challenge, the inbounds region 401 of the game board 400 may be preset with one or more tiles as obstacles to each player's movement during his turn in sequence. Thus, although game play begins in FIG. 4 with a game board 400 free of any tiles, it should be understood that such illustration is offered by way of example only and not limitation.

Figure 6:
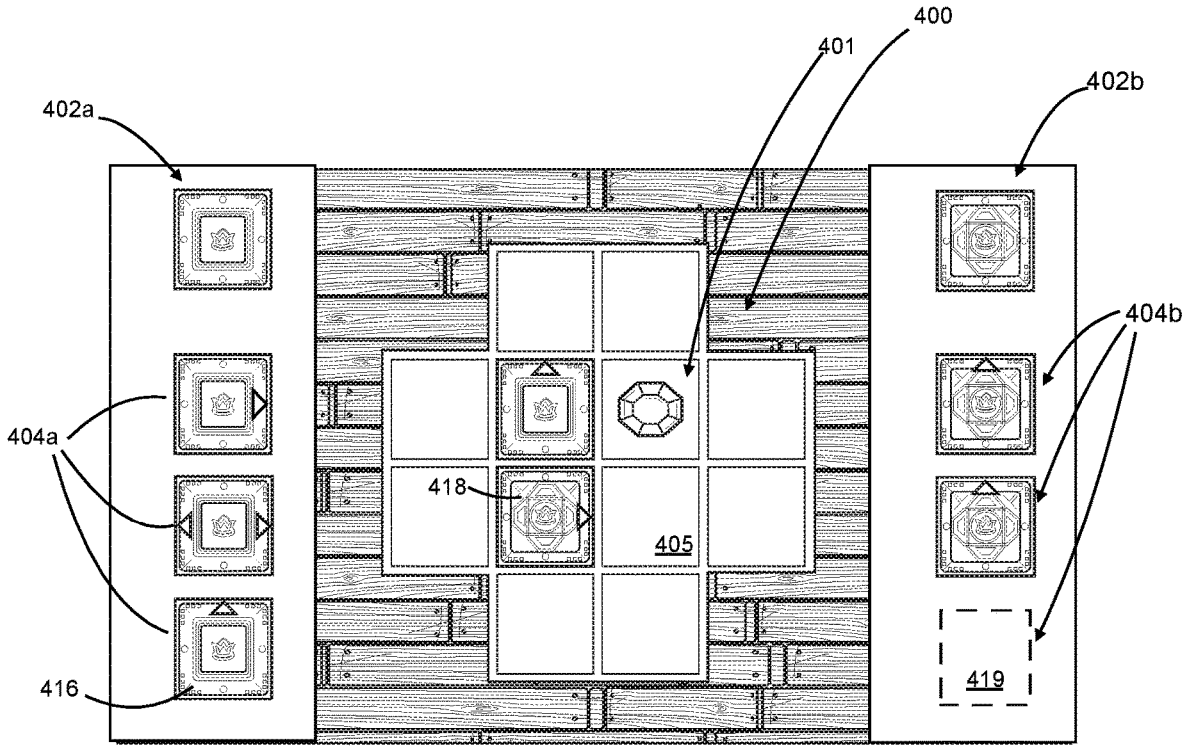
Figure 7:
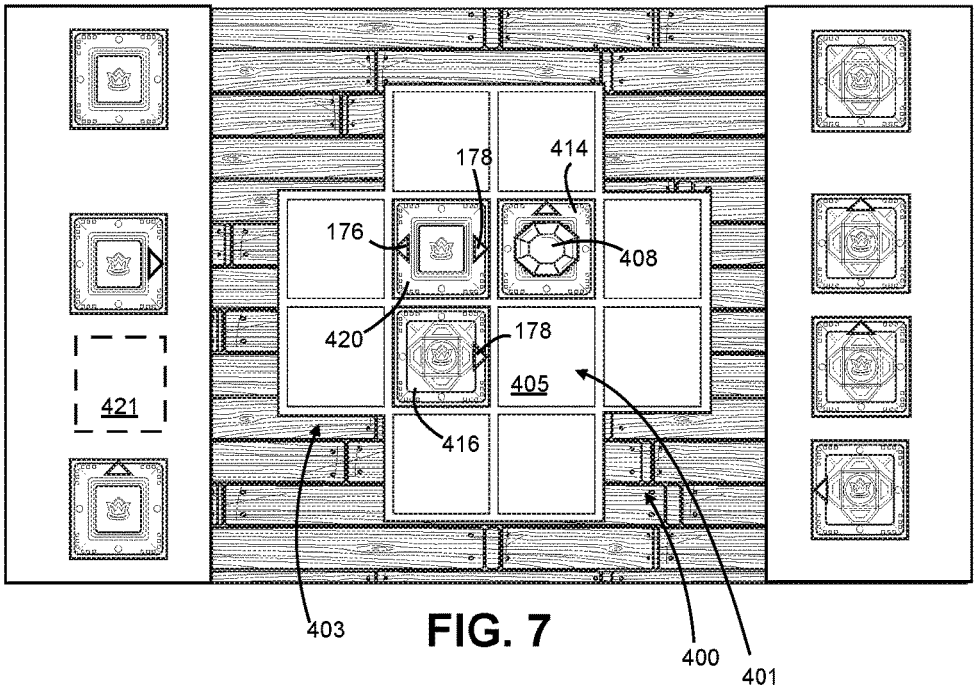

Turning to FIG. 6, it may be seen that the first player's hand 404*a* has been repopulated with a new tile 416, which has been drawn from the first player's deck 402*a*. FIG. 6 further shows that a second player, corresponding to the deck 402*b* and hand 404*b*, may select a tile 418 from his hand 404*b* (taken from the area defined by corresponding dashed box 419) for placement on a space 405 comprising the inbounds region 401 of the game board 400.

To this point, no movement indicators presented on tiles selected by either the first or the second player have been used to adjust the position of any tiles already placed on a space 405 defining the inbound 401 region of the board 400. However, in FIG. 7, the first player has selected a tile 420 (taken from the area defined by corresponding dashed box 421) for placement on a space 405 comprising the inbounds region 401 of the game board 400. Although another tile 414 previously occupied the space 405 now occupied by tile 420, movement indicators drawn as leftward and rightward arrowheads 176, 178 have been provided to allow the first player to strategically move any tiles occupying a space 405 defining the inbound 401 region of the board 400 in a leftward or rightward direction. Thus, previously placed tile 414 has been moved rightward, in accordance with allowable movement indicated by the rightward arrowhead, for example, to occupy the space 405 having a gem 408. Of course, it may have been possible to move tile 416 rightward according to the movement indicator on tile 420, or even move tile 414 leftward into the out of bounds region 403 flanking a left side of the inbounds region 401 of the game board 400, however, moving tile 414 rightward in accordance with the rightward arrowhead 178 on tile 420 put the first player at an advantage for occupying a space 405 having a gem 408 or other visually distinguishable mark of a goal.

Additionally, it is contemplated that moving any tiles into a space 405 defining the out of bounds region 403 may take that tile out of play. Thus, moving tile 414 leftward per the leftward arrowhead 176 on tile 420 may have disadvantaged the first player. Furthermore, although it may have been desirable to the first player to take the second player's tile 416 out of play by moving such tile 416 leftward onto a space 405 defining the out of bounds region 403 of the game board 400, it is contemplated that movement indicators may serve an additional role of defensively, though passively, preventing, or blocking, movement of tiles already placed on the game board 400 against their own movement indicators. In other words, in some embodiments, a tile having a rightward movement indicator may not be moved leftward, and vice versa. Similarly, a tile having an upward movement indicator may not be moved downward, and vice versa. As such, tile 420 may not be used to move tile 416 leftward by virtue of the rightward arrowhead 178 displayed on tile 416.

Figure 8:
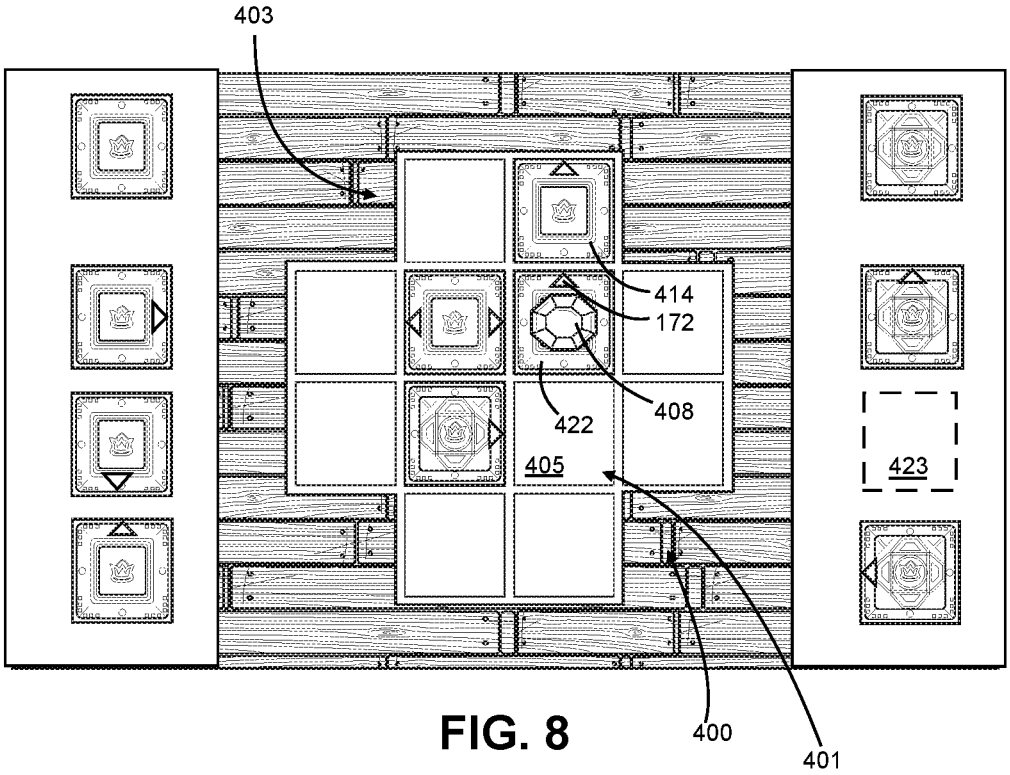

With reference to FIG. 8, it may be seen that the second player has selected a tile 422 (taken from the area defined by corresponding dashed box 423) for placement on a space 405 comprising the inbounds region 401 of the game board 400 and further displaying the desirable gem 408 which may be offered to visually distinguish a goal. Because such tile's 422 movement indicator comprises an upward arrowhead 172, the tile 422 was advantageously used, in the example, to move tile 414 upward into a space 405 defining the out of bounds region 403 of the game board 400.

Figure 9:
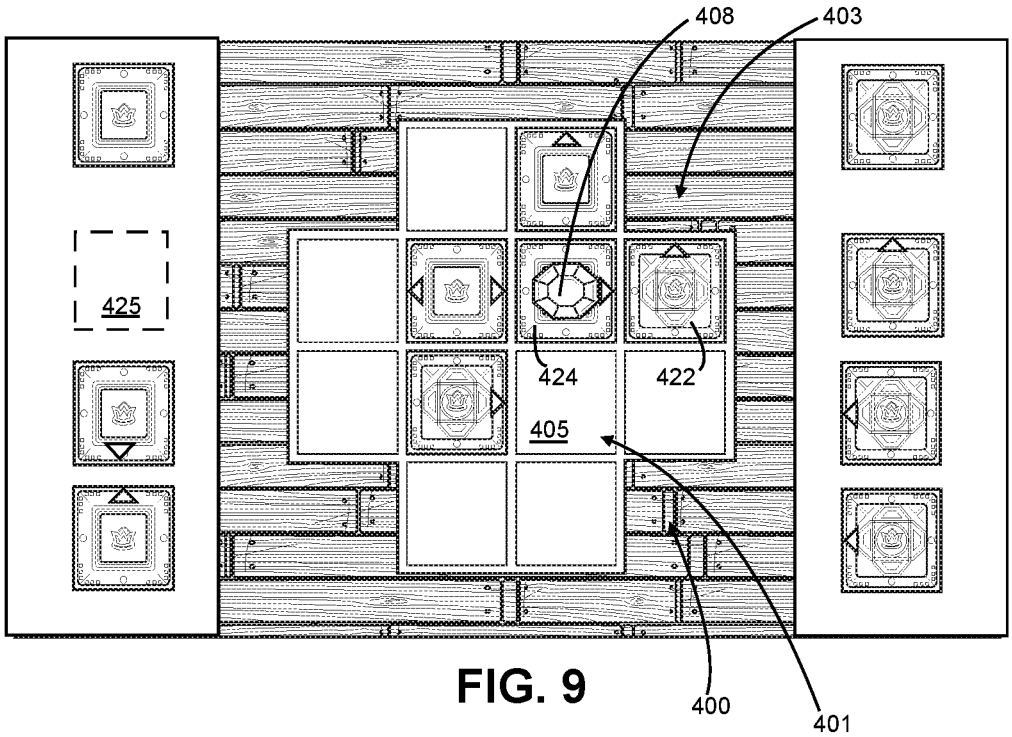

Similarly, with reference to FIG. 9, it may be seen that the first player has selected a tile 424 (taken from the area defined by corresponding dashed box 425) for placement on a space 405 comprising the inbounds region 401 of the game board 400 and further displaying the desirable gem 408 which may be offered to visually distinguish a goal. Because such tile's 424 movement indicator comprises a rightward arrowhead 178, the tile 424 was advantageously used, in the example drawn, to move tile 422 rightward into a space 405 defining the out of bounds region 403 of the game board 400.

Figure 10:
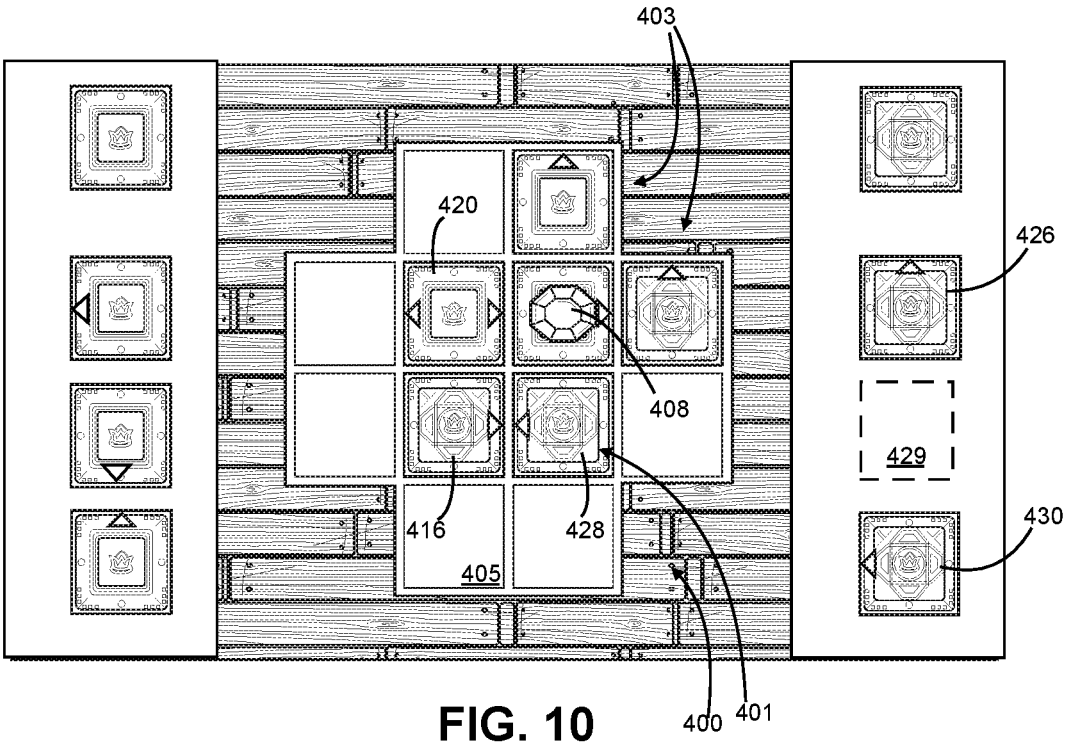

With reference next to FIG. 10, it may be seen that none of the second player's tiles 426, 428, and 430 remaining comprise movement indicators operative to move any of the tiles placed on the game board 400 in his favor. This is because, with respect to the first player's occupation of the space displaying the desirable gem 408, each of the second player's tiles either comprise opposing arrowheads, or are otherwise blocked by tiles occupying spaces 405 defining the out of bounds region 403 of the game board 400. As such, the second player will be unable to occupy the space displaying the desirable gem 408. Instead, the second player may move another tile occupying space defining the inbounds 401 region of the game board, where possible, or choose to place a tile in any unoccupied space, if permitted. In the figure, tile 428 (taken from the area defined by corresponding dashed box 429) occupies a remaining space 405 without moving any tiles on the game board 400. This action causes each of the spaces 405 defining the inbounds region 401 of the game board 400 to be occupied by various tiles 416, 420, 424, and 428 which itself may end the game. As the game ends, it may be seen that the first player's tile 424 occupies a space having a gem 408 on it, thus, the first player may be deemed the winner of the game. In the event that a plurality of spaces 405 depict a gem 408 or other visually distinguishing feature, a player whose tiles occupy a majority of such spaces 405 may be deemed the winner of the game.

Additional steps may include rewarding the winner of the game with one or more desirable digital or physical prizes, such as points or additional tiles, as the case may be, though providing a prize to the winner is not a necessary step to practice the invention.

Although tiles 414, 416, 420, 422, 424 and 430 have been described as selected and placed on the game board 400 at various times during completion of each players' turns in sequence, it is contemplated that other tiles may have been chosen, and of course may have been available, to carry out a competitive game in accordance with the method described with respect to FIG. 3 above. The foregoing sequence has been offered simply to illustrate one of innumerable outcomes of such method for the sake of clarifying possible operation of the method in practice.

Of course, movement indicators may operate in a variety of ways and the foregoing are offered by way of example only and not of limitation. For instance, exceptions to defensive blocking as described may indicated with colors or other additional features.

Figure 11:
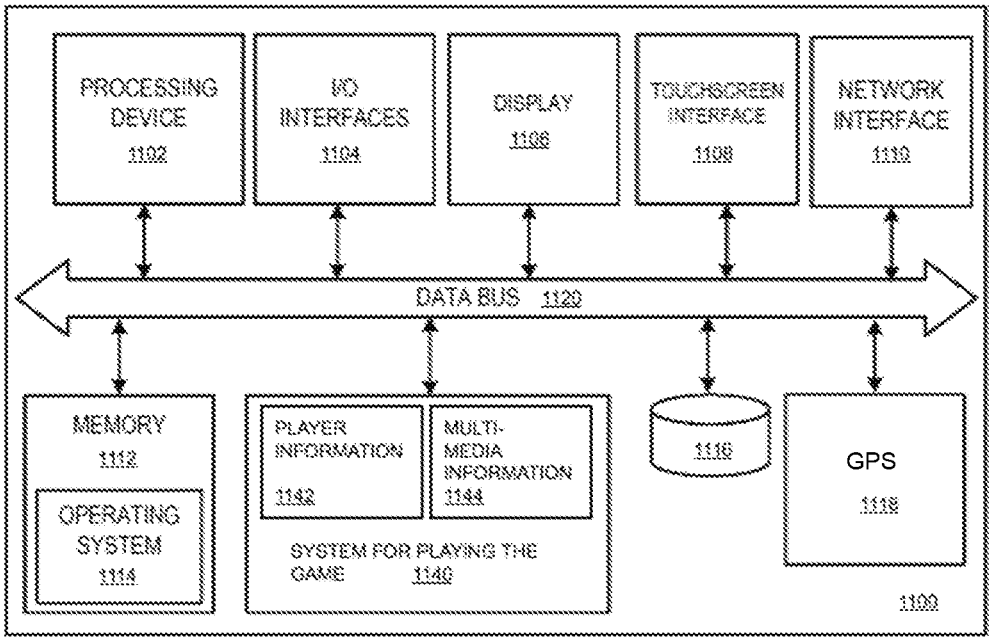
FIG. 11 is a block diagram illustrating an exemplary embodiment of an electronic device configured to implement the game.

Electronic embodiments of the game are also contemplated. FIG. 11 illustrates an exemplary electronic device 1100 configured to implement the game. Electronic device 1100 may be a tablet computer or smartphone but may also be embodied in any one of a wide variety of wired and/or wireless computing devices such as desktop, laptop, or even tablet computers. The electronic device 1100 may include a processing device (processor) 1102, input/output interfaces 1104, a display 1104, a touchscreen interface 1108, a network interface 1110, a memory 1112, and operating system 1114, a mass storage 1116 and an GPS 1118, with each communicating across a local data bus 1120. Additionally, electronic device 1100 may incorporate a system 1140 for playing the game, player information 1142 and multimedia information 1144, although the location of information 1142 and 1144 could vary.

The processing device 1102 may include any custom made or commercially available processor, a central processing unit (CPU) or an auxiliary processor among several processors associated with the electronic device 1100, a semiconductor based microprocessor (in the form of a microchip), a macroprocessor, one or more application specific integrated circuits (ASICs), a plurality of suitably configured digital logic gates, and other electrical configurations comprising discrete elements both individually and in various combinations to coordinate the overall operation of the system.

The memory 1112 can include any one of a combination of volatile memory elements (e.g., random-access memory (RAM, such as DRAM, and SRAM, etc.)) and nonvolatile memory elements. The memory typically comprises native operating system 1114, one or more native applications, emulation systems, or emulated applications for any of a variety of operating systems and/or emulated hardware platforms, emulated operating systems, etc. For example, the applications may include application specific software which may comprise some or all the components of the electronic device 1100. In accordance with such embodiments, the components are stored in memory and executed by the processing device. Note that although depicted separately, the system 1140 may be resident in memory such as memory 1112.

Where the electronic device 1100 is embodied as a smartphone or tablet computer, touchscreen interface 1108 is configured to detect contact within the display area of the display 1106 and provides such functionality as on-screen buttons, menus, keyboards, etc. that allows users to navigate user interfaces by touch. For some embodiments, the electronic device 1100 will comprise GPS 1118 or other means to determine the location of the mobile device 1100.

Figure 12:
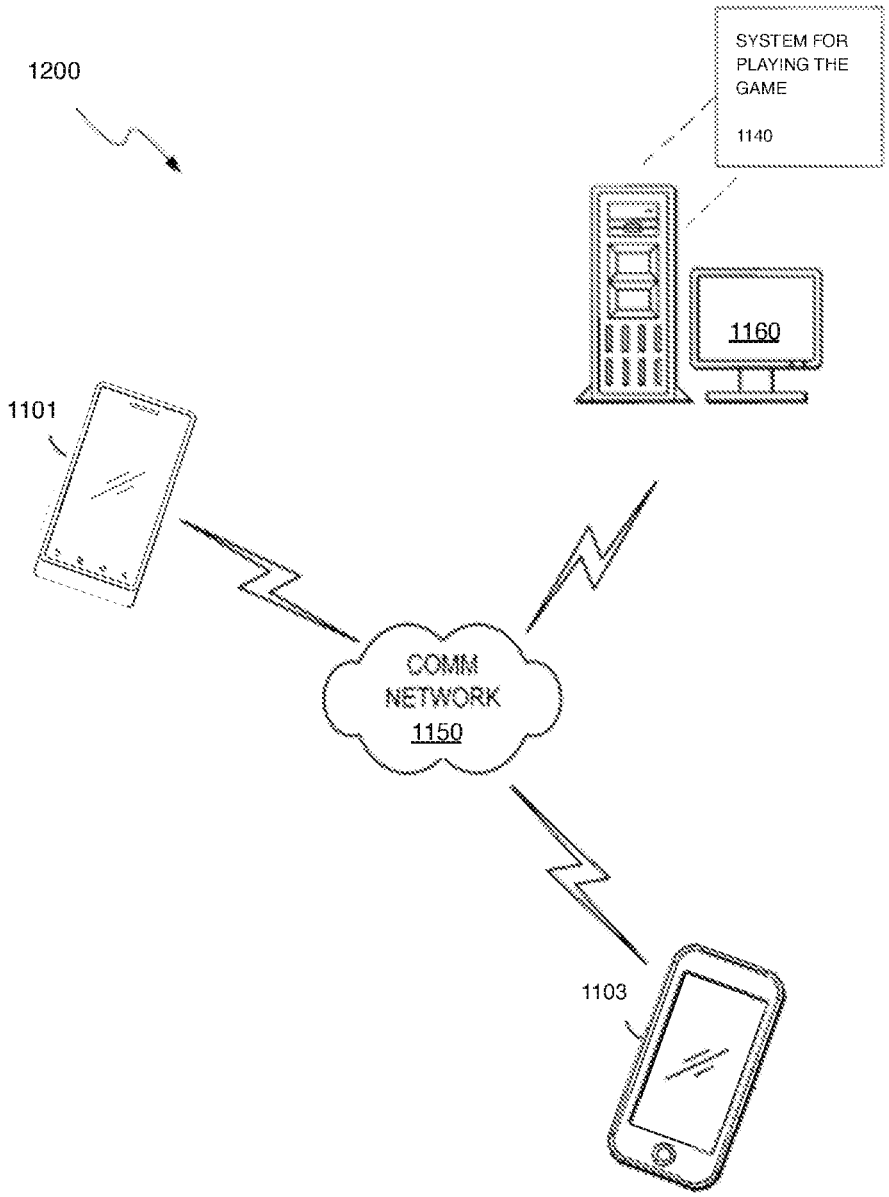
FIG. 12 is a diagram of a networked environment in which an exemplary embodiment of a system for playing the game may be implemented.

One of ordinary skill in the art will appreciate that the memory 1114 can, and typically will, comprise other components which have been omitted for purposes of brevity. Note that in the context of this disclosure, a non-transitory computer-readable medium stores one or more programs for use by or in connection with an instruction execution system, apparatus, or device. With further reference to FIG. 11, network interface device 1110 comprises various components used to transmit and/or receive data over a networked environment such as depicted in FIG. 12. When such components are embodied as an application, the one or more components may be stored on a non-transitory computer-readable medium and executed by the processing device.

FIG. 12 is illustrative of a networked environment 1200 in which an embodiment of a system for playing the game 1140 is implemented. As shown in FIG. 12, system 1140 comprises a plurality of personal electronic devices. By way of example, and not limitation, two mobile electronic devices 1101 and 1103 are shown communicatively coupled via a communication network 1150. Each of the mobile devices may be embodied as a mobile computing device such as, for example and without limitation, a smartphone that incorporates cellular telephone functionality. Notably, the communications network can use one or more of various communications types such as, for example and without limitation, cellular and Wi-Fi communications.

Users of mobile devices 1101 and 1103 may use their devices to become members of a social network that enables them to interact with each other using their mobile devices 1101 and 1103 and exchange information pertinent to the game. In this exemplary embodiment, the social network may be facilitated by a website that is hosted by social network server 1160. As such, server 1160 facilitates interaction among a limited group of members, or players of the game, as may be established by the players themselves. For the purpose of the example presented in FIG. 12, the players are the users of mobile devices 1101 and 1103.

Additionally, server 1160 implements the system for playing the game 1140 and facilitates sharing information related to the game amongst players in the social network. Specifically, the server 1160 implements the steps outlined in FIG. 3. Accordingly, a player in the social network can access the server 1160 using their mobile devices 1101 and 1103 and can obtain information regarding other players and information relating to the games played between them.

In order to facilitate the aforementioned functionality, various aspects may be performed by one or more of the mobile devices 1101 and 1103. In one embodiment, the mobile devices are operative to perform, at least in part, the method depicted in the flowchart of FIG. 3 and described above. With respect to operation of system for playing the game 1140, the system 1140 is also operative to perform, at least in part, the method depicted in the flowchart of FIG. 3.

If embodied in software, it should be noted that each block depicted in the accompanying flowcharts represents a module, segment, or portion of code that comprises program instructions stored on a non-transitory computer readable medium to implement the specified logical function(s). In this regard, the program instructions may be embodied in the form of source code that comprises statements written in a programming language or machine code that comprises numerical instructions recognizable by a suitable execution system such as the electronic device 1100. The machine code may be converted from the source code, etc. If embodied in hardware, each block may represent a circuit or a number of interconnected circuits to implement the specified logical function(s).

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, any visual elements comprising the game may vary depending on aesthetic tastes. As another example, the game board may vary, and the number of players may increase from two to as many players as desired. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the game and method of playing the same with which that terminology is associated. In general, the terms used in the following claims should not be constructed to limit the game and method of playing the same to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the game and method of playing the same is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the game and method of playing the same.

What is claimed is:

1. A method of playing games involving 2 or more players, comprising:

providing at least a first deck and a second deck corresponding to a first player and a second player, respectively, each deck comprising a plurality of tiles, and each tile having at least one of a leftward, rightward, upward, or downward arrowhead defining a movement indicator visible thereon;

generating a first and a second playing hand comprising a plurality of tiles from each of the first and second decks, respectively; and receiving from each player by turns in sequence, one or more of the steps of:

a) selecting a tile from the player's hand for placement on a game board;

b) moving one or more tiles already occupying any spaces comprising the game board in accordance with any movement indicators on the selected tile; and c) repopulating the player's hand with tiles from the player's deck;

wherein the game board comprises an inbounds region defined by a plurality of laterally and longitudinally contiguous inbounds spaces arranged as a square grid, at least one of the inbounds spaces defining at least one goal space within the inbounds region; and wherein the game board comprises an out of bounds region, the out of bounds region comprising a plurality of out of bounds spaces, one each of the out of bounds spaces outwardly aligned with an inbounds space situated along each side of the inbounds region such that the number of out of bounds spaces on each side of the inbounds region is equal to number of inbounds spaces spaces defining the length of each side of the inbounds region of the game board; and wherein turns are executed in sequence until a game-ending event occurs.

2. The method of claim 1, wherein the game-ending event occurs when a player is unable to select a tile that would affect the occupation of any goal space in such player's favor.

3. The method of claim 1, wherein the game-ending event occurs when each space comprising the inbounds region of the game board is occupied by a tile.

4. The method of claim 1, wherein the player whose tiles occupy the greatest number of goal spaces at the end of the game is deemed the winner.

5. The method of claim 1, wherein a player executing such player's turn in sequence, may cause a tile already occupying a space on the game board to move upward, downward, leftward, or rightward in accordance with the direction of any movement indicators on such player's selected tile, into an adjacent unoccupied space comprising the board.

6. The method of claim 5, wherein a player is prevented from causing a tile already occupying a space on the game board to move in a direction opposite of a direction defined by any of such tile's movement indicators.

7. The method of claim 1, wherein a player is prevented from placing a selected tile directly on a goal space.

8. The method of claim 1, wherein one of the players is a computer programmed to execute one or more turns in sequence with a human player.

9. The method of claim 1, wherein the turns executed in sequence by the first player are performed at a first electronic device, and wherein the turns executed in sequence by the second player are performed at a second electronic device.

10. A game for 2 or more players, comprising:

a game board having an inbounds region defined by laterally and longitudinally contiguous inbounds spaces arranged as a square grid, at least one of the inbounds spaces defining at least one goal space within the inbounds region;

an out of bounds region comprising a plurality of out of bounds spaces, one each of the out of bounds spaces outwardly aligned with an inbounds space situated along each side of the inbounds region such that the number of out of bounds spaces on each side of the inbounds region is equal to the number of inbounds spaces defining the length of each side of the inbounds region of the game board; and a first and a second deck of selectable tiles, the first and second deck corresponding to a first and second player respectively, each of the selectable tiles having at least one of a leftward, rightward, upward, or downward arrowhead defining one or more movement indicators providing instructions regarding any of movement of another tile on the game board and prohibition of placement of a tile onto the game board;

wherein each of the at least one goal spaces within the inbounds region are non-contiguous with one another and visually distinguishable from the remaining spaces within the inbounds region.

11. A non-transitory, tangible computer-readable medium having stored thereon computer-executable instructions, which, when executed by a computer processor, enable performance of the method comprising:

receiving, at a first computing device, member information corresponding to members of a social network;

providing, at a first computing device, at least a first deck and a second deck corresponding to a first player and a second player, respectively, each deck comprising a plurality of tiles, and each tile having at least one movement indicator visible thereon;

generating, at a first computing device, a first and a second playing hand comprising a plurality of tiles from each of the first and second decks, respectively; and instructing, at a first computing device, each player to execute turns in sequence with other players, wherein each player's turn comprises one or more of the steps of:

a) selecting a tile from the player's hand for placement on a game board;

b) moving one or more tiles already occupying any spaces comprising the game board in accordance with any movement indicators on the selected tile; and c) repopulating the player's hand with tiles from the player's deck;

wherein the game board comprises an inbounds region defined by laterally and longitudinally contiguous spaces arranged as a grid, the game board having at least one goal space within the inbounds region; and wherein turns are executed in sequence until a game-ending event occurs.

* * * * *